US011199340B2

(12) United States Patent
Khatami

(10) Patent No.: US 11,199,340 B2
(45) **Date of Patent: *Dec. 14, 2021**

(54) DIFFUSER PLATES AND DIFFUSER PLATE ASSEMBLIES

(71) Applicant: Rheem Manufacturing Company, Atlanta, GA (US)

(72) Inventor: Reza David Khatami, Atlanta, GA (US)

(73) Assignee: Rheem Manufacturing Company, Atlanta, GA (US)

( * ) Notice: Subject to any disclaimer, the term of this patent is extended or adjusted under 35 U.S.C. 154(b) by 87 days.

This patent is subject to a terminal disclaimer.

(21) Appl. No.: 16/593,493

(22) Filed: Oct. 4, 2019

(65) Prior Publication Data

US 2020/0033026 A1 Jan. 30, 2020

Related U.S. Application Data

(62) Division of application No. 15/584,834, filed on May 2, 2017, now Pat. No. 10,502,451.

(51) Int. Cl.
*F28F 9/02* (2006.01)
*F24H 1/36* (2006.01)
(Continued)

(52) U.S. Cl.
CPC ..... *F24H 1/36* (2013.01); *F28D 7/163* (2013.01); *F28D 21/0007* (2013.01);
(Continued)

(58) Field of Classification Search
CPC ..... F24H 1/36; F28D 7/1607; F28D 7/163; F28D 7/1646; F28D 21/0007; F28F 9/007;
(Continued)

(56) References Cited

U.S. PATENT DOCUMENTS 1,798,354 A 3/1931 Ris
2,496,301 A * 2/1950 Meixl ..... F28F 21/02 165/134.1
(Continued)

FOREIGN PATENT DOCUMENTS

CN 202329369 7/2012
EP 3029407 A1 6/2016
(Continued)

OTHER PUBLICATIONS

International Search Report for PCT/US2018/028378 dated Jul. 5, 2018.

*Primary Examiner* — Eric S Ruppert
*Assistant Examiner* — Hans R Weiland
(74) *Attorney, Agent, or Firm* — Troutman Pepper Hamilton Sanders LLP

(57) ABSTRACT

A diffuser plate for a thermal transfer device can include a body having a number of first apertures and a second aperture that traverse therethrough, where the first apertures are asymmetrically arranged with respect to the second aperture. The first apertures can have a first shape and a first size, and where the first apertures are configured to receive a plurality of tubes. The second aperture has a second size, where the second size is larger than the first size.

20 Claims, 5 Drawing Sheets

(51) Int. Cl.

| | |
|---|---|
| ***F28F 9/18*** | (2006.01) |
| ***F28D 7/16*** | (2006.01) |
| ***F28D 21/00*** | (2006.01) |
| ***F28F 21/00*** | (2006.01) |
| *F28F 21/08* | (2006.01) |
| *F28F 21/04* | (2006.01) |
| *F28F 21/06* | (2006.01) |

(52) U.S. Cl.
CPC ..... *F28F 9/0202* (2013.01); *F28F 9/18* (2013.01); *F28F 21/003* (2013.01); *F28F 21/006* (2013.01); *F28F 21/045* (2013.01); *F28F 21/068* (2013.01); *F28F 21/083* (2013.01); *F28F 21/084* (2013.01); *F28F 2255/08* (2013.01); *F28F 2255/14* (2013.01); *F28F 2255/16* (2013.01); *F28F 2255/18* (2013.01)

(58) Field of Classification Search
CPC ..... F28F 9/013; F28F 9/0131; F28F 9/0202; F28F 21/003
See application file for complete search history.

(56) References Cited

U.S. PATENT DOCUMENTS 3,566,961 A * 3/1971 Lorenz ..... F28D 7/1607 165/159
3,907,030 A * 9/1975 Moss ..... F28F 9/22 165/162
5,366,188 A * 11/1994 Kramer ..... F28F 9/0131 248/68.1
5,505,254 A * 4/1996 Chiba ..... F28F 9/0131 165/148
6,142,215 A 11/2000 Paulsen et al.
6,167,951 B1 * 1/2001 Couch ..... F28D 7/1669 165/159
6,273,180 B1 * 8/2001 Joshi ..... F28D 7/1607 165/11.1
8,091,514 B2 * 1/2012 Jimenez ..... F28D 21/0007 122/20 B
2002/0038702 A1 * 4/2002 Font-Freide ..... F28D 7/1653 165/159
2006/0231243 A1 * 10/2006 Sugihara ..... F28F 9/0131 165/158
2008/0038165 A1 * 2/2008 Burlingame ..... F28F 9/0131 422/608
2008/0190593 A1 * 8/2008 Wang ..... F28F 9/0131 165/159
2010/0116478 A1 * 5/2010 Wanni ..... F28F 9/0131 165/162
2017/0045310 A1 * 2/2017 Choi ..... F28D 7/1646

FOREIGN PATENT DOCUMENTS

EP 3130876 A1 2/2017
JP 2014-169840 9/2014

* cited by examiner

DIFFUSER PLATES AND DIFFUSER PLATE ASSEMBLIES

CROSS REFERENCE TO RELATED APPLICATIONS

This application is a divisional application of and claims priority under 35 U.S.C. § 121 to U.S. patent application Ser. No. 15/584,834, titled "Diffuser Plates and Diffuser Plate Assemblies" and filed on May 2, 2017, the entire contents of which are hereby incorporated herein by reference.

TECHNICAL FIELD

Embodiments described herein relate generally to heat exchangers, and more particularly to diffuser plates and assemblies of diffuser plates for heat exchangers.

BACKGROUND

Heat exchangers, boilers, combustion chambers, water heaters, and other similar devices control or alter thermal properties of one or more fluids. In some cases, one or two diffuser plates are disposed within these devices to hold one or more tubes (e.g., heat exchanger tubes, condenser tubes) in place. The diffuser plates help make the flow of fluids more uniform in the heat exchanger system. Diffuser plates can correct the flow direction of fluids inside the device. Diffuser plates can also help keep fluids from flowing through short cuts in the devices.

SUMMARY

In general, in one aspect, the disclosure relates to a diffuser plate for a thermal transfer device. The diffuser plate can include a body having a plurality of first apertures and a second aperture that traverse therethrough, where the plurality of first apertures are asymmetrically arranged with respect to the second aperture. The plurality of first apertures can have a first shape and a first size, and where the plurality of first apertures are configured to receive a plurality of tubes. The second aperture can have a second size, where the second size is larger than the first size.

In another aspect, the disclosure can generally relate to a diffuser plate assembly for a thermal transfer device. The diffuser plate assembly can include a first diffuser plate having a first body having a plurality of first apertures and a second aperture, where the plurality of first apertures and the second aperture traverse through the first diffuser plate. The diffuser plate assembly can also include a second diffuser plate placed in parallel with the first diffuser plate, where the second diffuser plate comprises a second body having a plurality of third apertures and a fourth aperture. The plurality of first apertures and the plurality of third apertures can have a first shape and a first size, where the plurality of first apertures is configured to receive a first end of a plurality of tubes and the plurality of third apertures is configured to receive a second end of the plurality of tubes. The second aperture can have a second size, where the second size is larger than the first size. The second aperture of the first diffuser plate and the fourth aperture of the second diffuser plate can be misaligned when the first diffuser plate is placed in parallel with the second diffuser plate, such as when the first diffuser plate is coupled to the first end of the plurality of tubes and the second diffuser is coupled to the second end of the plurality of tubes.

These and other aspects, objects, features, and embodiments will be apparent from the following description and the appended claims.

BRIEF DESCRIPTION OF THE DRAWINGS

The drawings illustrate only example embodiments of diffuser plates and diffuser plate assemblies and are therefore not to be considered limiting of its scope, as diffuser plates and diffuser plate assemblies may admit to other equally effective embodiments. The elements and features shown in the drawings are not necessarily to scale, emphasis instead being placed upon clearly illustrating the principles of the example embodiments. Additionally, certain dimensions or positionings may be exaggerated to help visually convey such principles. In the drawings, reference numerals designate like or corresponding, but not necessarily identical, elements.

DETAILED DESCRIPTION OF EXAMPLE EMBODIMENTS

Figure 1B:
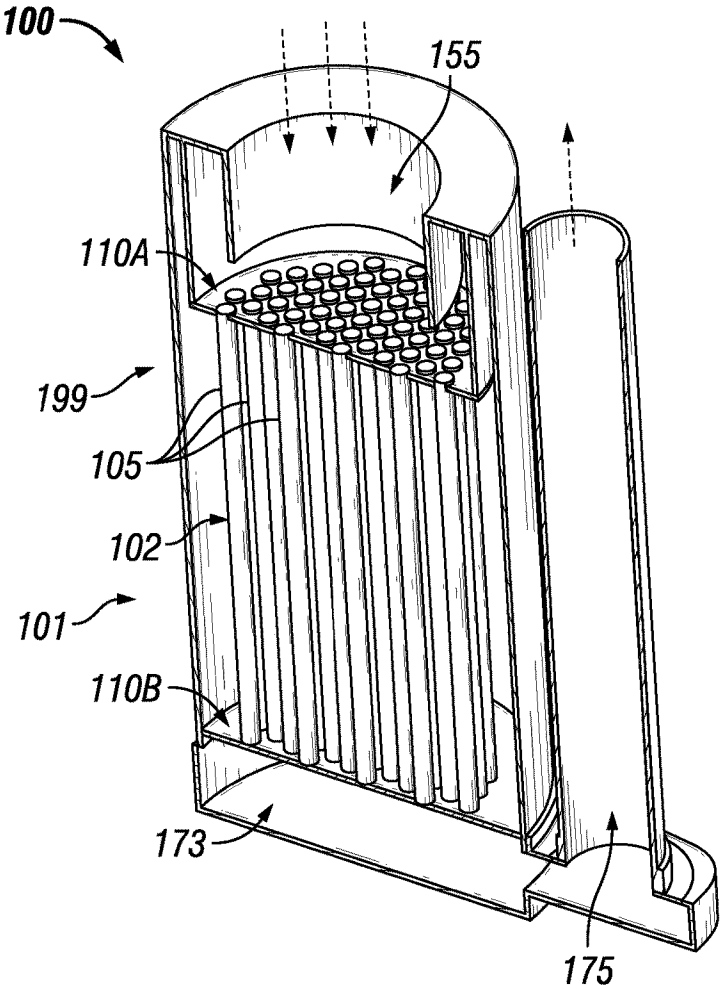
FIG. 1B (Prior Art)
FIGS. 1A and 1B show of a boiler in which the example embodiments of diffuser plates and diffuser plate assemblies as described herein can be implemented.

The example embodiments discussed herein are directed to systems, methods, and devices for diffuser plates and diffuser plate assemblies. Example embodiments can be directed to any of a number of thermal transfer devices, including but not limited to boilers, condensing boilers, heat exchangers, and water heaters. Further, one or more of any number of fluids can flow through example tubes (also called heat exchanger tubes or HX tubes herein) and/or tube assemblies. Examples of such fluids can include, but are not limited to, water, deionized water, steam, glycol, and dielectric fluids.

Example embodiments can be pre-fabricated or specifically generated (e.g., by shaping a malleable body) for a particular boiler or other vessel. Example embodiments can have standard or customized features (e.g., shape, size, features on the inner surface, pattern, configuration). Therefore, example embodiments described herein should not be considered limited to creation or assembly at any particular location and/or by any particular person.

The diffuser plates and diffuser plate assemblies (or components thereof) described herein can be made of one or more of a number of suitable materials and/or can be configured in any of a number of ways to allow the tubes (or devices (e.g., boiler, heat exchanger) in which the diffuser plates and diffuser plate assemblies are disposed) to meet certain standards and/or regulations while also maintaining reliability of the tubes, regardless of the one or more conditions under which the diffuser plates and diffuser plate assemblies can be exposed. Examples of such materials can include, but are not limited to, aluminum, stainless steel, ceramic, fiberglass, glass, plastic, and rubber.

As discussed above, diffuser plates and diffuser plate assemblies (or vessels in which diffuser plates and diffuser plate assemblies are disposed) can be subject to complying with one or more of a number of standards, codes, regulations, and/or other requirements established and maintained by one or more entities. Examples of such entities can include, but are not limited to, the American Society of Mechanical Engineers (ASME), American Society of Heating, Refrigeration and Air Conditioning Engineers (ASHRAE), Underwriters' Laboratories (UL), American National Standard Institute (ANSI), the National Electric Code (NEC), and the Institute of Electrical and Electronics Engineers (IEEE). An example diffuser plate and/or diffuser plate assembly allows a vessel (e.g., boiler, heat exchanger) to continue complying with such standards, codes, regulations, and/or other requirements. In other words, an example diffuser plate or diffuser plate assembly, when disposed within a vessel, does not compromise compliance of the vessel with any applicable codes and/or standards.

Any example diffuser plates and diffuser plate assemblies, or portions thereof, described herein can be made from a single piece (e.g., as from a mold, injection mold, die cast, 3-D printing process, extrusion process, stamping process, or other prototype methods). In addition, or in the alternative, an example diffuser plate or diffuser plate assembly (or portions thereof) can be made from multiple pieces that are mechanically coupled to each other. In such a case, the multiple pieces can be mechanically coupled to each other using one or more of a number of coupling methods, including but not limited to epoxy, welding, fastening devices, compression fittings, mating threads, and slotted fittings. One or more pieces that are mechanically coupled to each other can be coupled to each other in one or more of a number of ways, including but not limited to fixedly, hingedly, removeably, slidably, and threadably.

As described herein, a user can be any person that interacts with diffuser plates and/or diffuser plate assemblies. Examples of a user may include, but are not limited to, an engineer, a maintenance technician, a mechanic, an employee, an operator, a consultant, a contractor, and a manufacturer's representative. Components and/or features described herein can include elements that are described as coupling, fastening, securing, abutting, or other similar terms. Such terms are merely meant to distinguish various elements and/or features within a component or device and are not meant to limit the capability or function of that particular element and/or feature. For example, a feature described as a "coupling feature" can couple, secure, fasten, abut, and/or perform other functions aside from merely coupling.

A coupling feature (including a complementary coupling feature) as described herein can allow one or more components and/or portions of a diffuser plate or diffuser plate assembly to become coupled, directly or indirectly, to another portion of a diffuser plate or diffuser plate assembly. A coupling feature can include, but is not limited to, a snap, a clamp, a portion of a hinge, an aperture, a recessed area, a protrusion, a slot, a spring clip, a tab, a detent, and mating threads. One portion of an example diffuser plate or diffuser plate assembly can be coupled to a vessel by the direct use of one or more coupling features.

In addition, or in the alternative, a portion of an example diffuser plate or diffuser plate assembly can be coupled to a vessel using one or more independent devices that interact with one or more coupling features disposed on a component of the diffuser plate or diffuser plate assembly. Examples of such devices can include, but are not limited to, a pin, a hinge, a fastening device (e.g., a bolt, a screw, a rivet), epoxy, glue, adhesive, tape, and a spring. One coupling feature described herein can be the same as, or different than, one or more other coupling features described herein. A complementary coupling feature as described herein can be a coupling feature that mechanically couples, directly or indirectly, with another coupling feature.

Any component described in one or more figures herein can apply to any other figures having the same label. In other words, the description for any component of a figure can be considered substantially the same as the corresponding component described with respect to another figure. Further, a statement that a particular embodiment (e.g., as shown in a figure herein) does not have a particular feature or component does not mean, unless expressly stated, that such embodiment is not capable of having such feature or component. For example, for purposes of present or future claims herein, a feature or component that is described as not being included in an example embodiment shown in one or more particular drawings is capable of being included in one or more claims that correspond to such one or more particular drawings herein. The numbering scheme for the components in the figures herein parallel the numbering scheme for the corresponding components described in another figure in that each corresponding component is a three or four digit number having the identical last two digits. For any figure shown and described herein, one or more of the components may be omitted, added, repeated, and/or substituted. Accordingly, embodiments shown in a particular figure should not be considered limited to the specific arrangements of components shown in such figure.

Example embodiments of diffuser plates and diffuser plate assemblies will be described more fully hereinafter with reference to the accompanying drawings, in which example embodiments of diffuser plates and diffuser plate assemblies are shown. Diffuser plates and diffuser plate assemblies may, however, be embodied in many different forms and should not be construed as limited to the example embodiments set forth herein. Rather, these example embodiments are provided so that this disclosure will be thorough and complete, and will fully convey the scope of diffuser plates and diffuser plate assemblies to those of ordinary skill in the art. Like, but not necessarily the same, elements (also sometimes called components) in the various figures are denoted by like reference numerals for consistency.

Terms such as "first," "second," "top," "bottom," "left," "right," "end," "back," "front," "side", "length," "width," "inner," "outer," "lower", and "upper" are used merely to distinguish one component (or part of a component or state of a component) from another. Such terms are not meant to denote a preference or a particular orientation, and are not meant to limit embodiments of diffuser plates and diffuser plate assemblies. In the following detailed description of the example embodiments, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

Figure 1A:
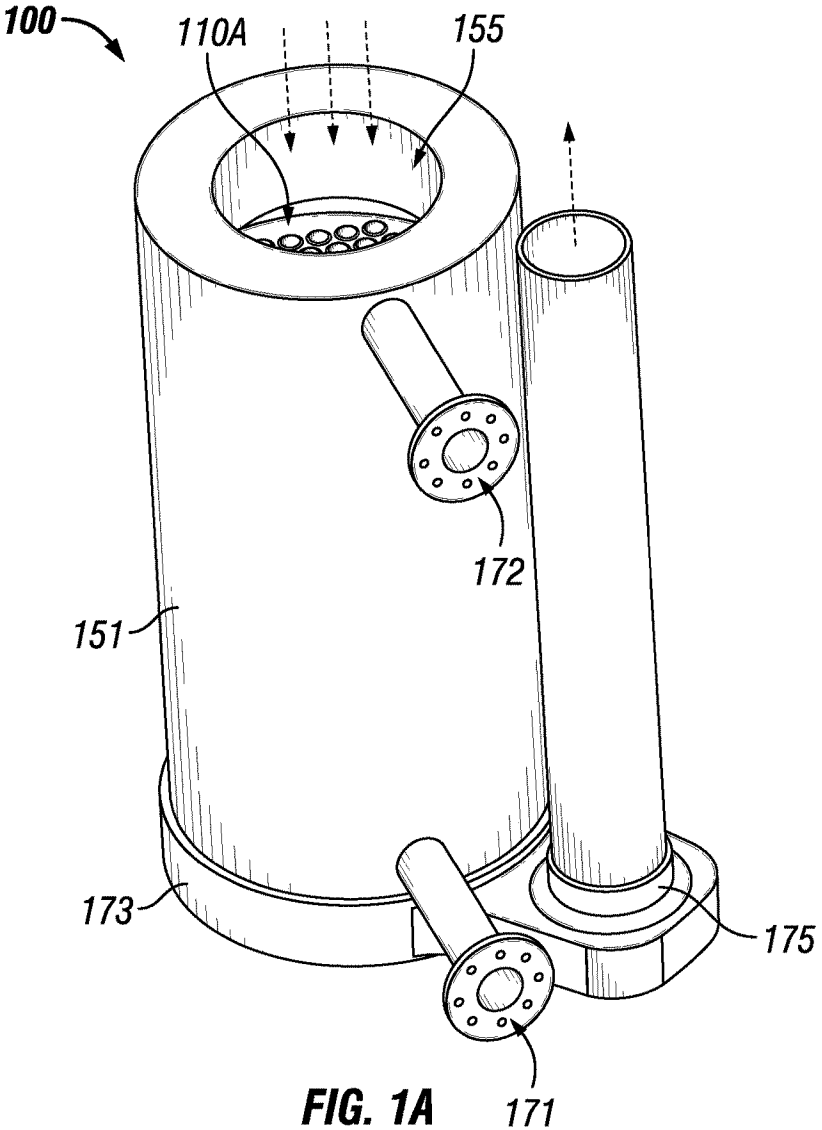
FIG. 1A (Prior Art)

FIGS. 1A and 1B show of a boiler 100 with a prior art diffuser plate which can be replaced with the example embodiments of diffuser plates and diffuser plate assemblies described herein. Specifically, FIG. 1A shows a perspective view of the boiler 100, and FIG. 1B shows a cross-sectional perspective view of the boiler 100. Referring to FIGS. 1A and 1B, the boiler 100 includes one or more of any number of components. For example, in this case, the boiler 100 includes at least one wall 151 that forms a cavity 155. Toward the bottom of the boiler is a flue gas collection chamber 173 that provides a bridge between the cavity 155 of the boiler 100 and an exhaust vent 175. Disposed within the cavity 155 in this case are two diffuser plates 110 (top diffuser plate 110A and bottom diffuser plate 110B) and a number of tubes 105 disposed between the diffuser plates 110. The two diffuser plates 110 can be called a diffuser assembly 199. The group of tubes 102 can be called a tube assembly 102. The combination of the diffuser assembly 199 and the tube assembly 102 can be called an assembly 101.

The boiler 100 uses a mixture of a fuel (e.g., natural gas, propane, coal) and air to transfer heat to a fluid (e.g., water), and the heated fluid (e.g., water, steam) can be used for some other process or purpose. In some cases, the fuel can be premixed with some other component, such as air. For example, the fuel/air mixture can be introduced into the top of the boiler 100, as shown at the top of FIGS. 1A and 1B. Once inside the top part of the cavity 155, there can be some heat source (e.g., a burner, and ignitor) that raises the temperature of the fuel/air mixture, resulting in combustion and burning of the fuel/air mixture. From there, the resulting hot gases (byproducts of the combustion of the fuel/air mixture) can be directed into the various tubes 105 and travel down those tubes 105 to the collection chamber 173. The hot gases then continue on to the exhaust vent 175 and leaves the boiler 100. The water vapor in the combustion products can either be in the vapor phase (non-condensing mode) or in the liquid phase (condensing mode), depending on the design of the boiler 100.

At the same time another fluid (e.g., water) is brought into the bottom part of the boiler 100 through the inlet 171. Once inside the cavity 155, the fluid comes into contact with the outer surfaces of the HX tubes 105. In many cases, the tubes 105 are made of a thermally conductive material. In this way, when the hot gases (from the combustion process) travels down the HX tubes 105, some of the heat from the fuel is transferred to the walls of the tubes 105. Further, as the fluid comes into contact with the outer surface of the walls of the HX tubes 105, some of the heat captured by the walls of the tubes HX 105 from the heated fuel is transferred to the fluid in the cavity 155. The heated fluid is drawn up toward the top of the cavity 155 of the boiler 100, and is then drawn out of the boiler 100 through the outlet 172. The heated fluid can then be used for one or more other processes, such as space heating and hot water for use in a shower, a clothes washing machine, and/or a dishwashing machine.

The HX tubes 105 are held in place within the cavity 155 of the boiler by tube sheets and the diffuser plates 110. The diffuser plates 110 can be coupled to an interior surface (e.g., disposed in a recess of an inner surface of the wall 151) of the boiler 100. Although the major role of the diffuser plates 110 is to redirect the flow and to make the flow uniform inside the cavity 155 and around the HX tubes 105, from structural point of view, the diffuser plates 110 can also be used, in conjunction with tube sheets, to maintain the position of the tubes HX 105 within the cavity 155.

Figure 2:
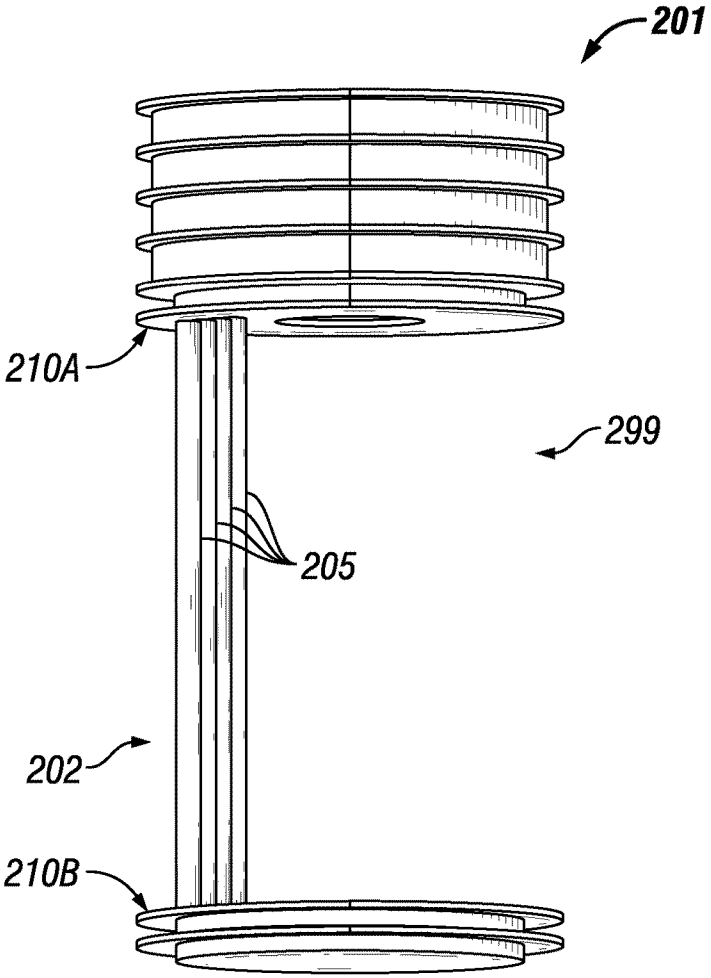
FIG. 2 (Prior Art)
FIG. 2 shows a subassembly for a boiler as currently used in the art.

FIG. 2 shows a subassembly 201 for a boiler currently used in the art. Referring to FIGS. 1A-2, the subassembly 201 includes two diffuser plates 210, with a top diffuser plate 210A being disposed near the top end of the HX tubes 205 close to a top tube sheet, and with the bottom diffuser plate 210B being disposed near the bottom end of the HX tubes 205 close to a bottom tube sheet. In the current art, the top diffuser plate 210A and the bottom diffuser plate 210B identical to each other and are shown in FIG. 3 below.

Figure 3:
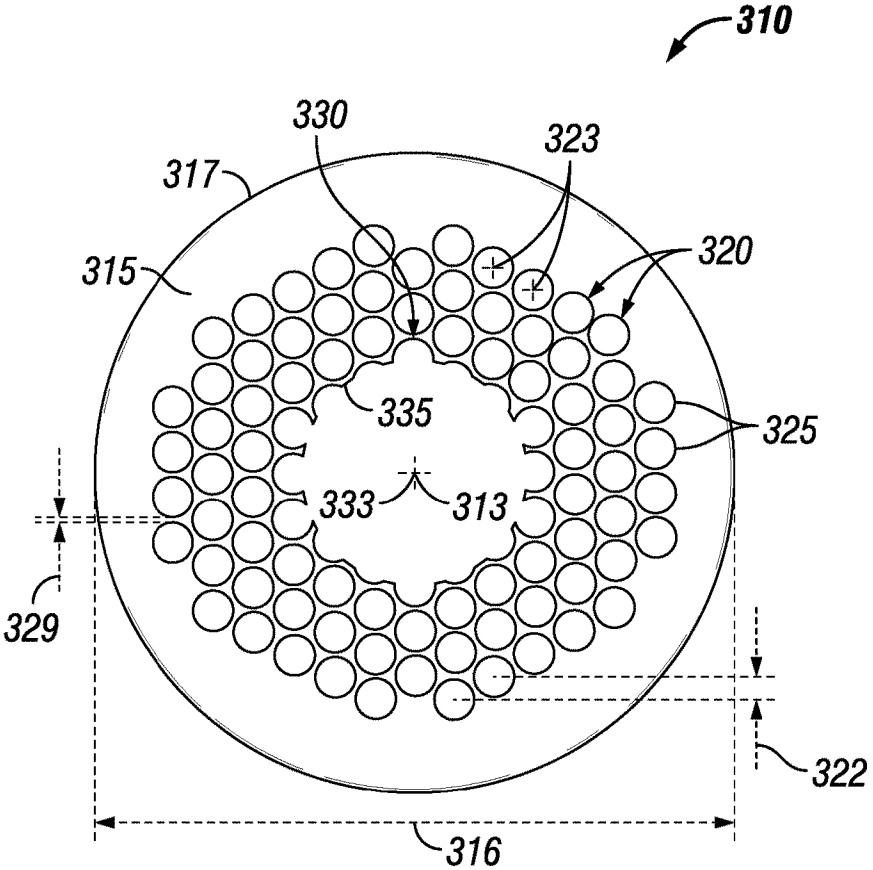
FIG. 3 (Prior Art)
FIG. 3 shows a diffuser plate currently used in the art.

FIG. 3 shows a top view of a diffuser plate 310 currently used in the art. Referring to FIGS. 1A-3, diffuser plate 310 of FIG. 3 has a body 315 through which a number of apertures traverse. The body 315 has an outer perimeter 317 that forms, when viewed from above, a circular shape having a diameter 316.

The diffuser plate 310 can have multiple apertures, where one of those apertures is larger than the other apertures and is centered at the center 313 of the body 315 of the diffuser plate 310. For example, in FIG. 3, there are a number of relatively smaller apertures 320 that traverse the body 315 of the diffuser plate 310 and are disposed in an organized manner around the center 313 of the body 315 of the diffuser plate 310. The apertures 320 are organized in linear columns where an adjacent column is offset by approximately ½ the height (in this case, also the diameter or two times the radius 322) of the aperture 320, so that the apertures 320 of adjacent columns almost touch each other and are separated by a distance 329.

Each aperture 320 has an outer perimeter 325 (which is part of the body 315) that forms, when viewed from above, a circle having a radius 322 and a center 323. As discussed above, there is also a larger aperture 330 that traverses the body 315 of the diffuser plate 310 and is disposed in the approximate center 313 (when viewed from above) of the body 315 of the diffuser plate 310. In other words, the approximate center 333 of aperture 330 is the same as the center 313 of the body 315 of the diffuser plate in this example. Aperture 330 has an outer perimeter 335 (which is also part of the body 315 of the diffuser plate 310) that is irregular when viewed from above because it is a larger circle cut into the pre-existing patter of smaller apertures 320. Put another way, the apertures 320 are arranged in a pattern, and the pattern is interrupted by the aperture 330 to create an arrangement of the apertures 320.

Figure 4:
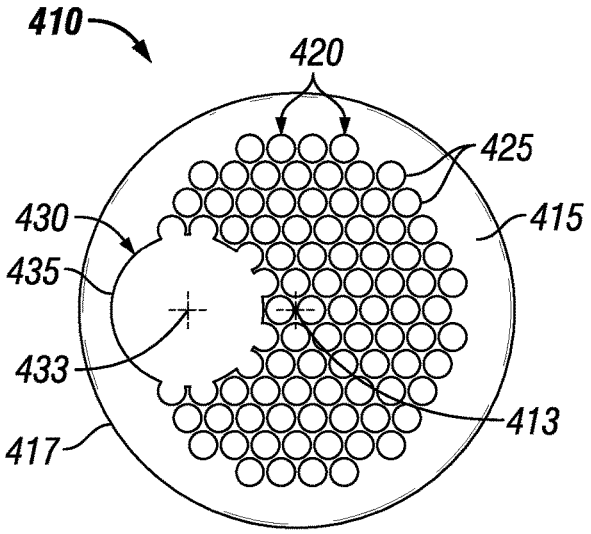
FIGS. 4-6 show diffuser plates in accordance with certain example embodiments.
Figure 5:
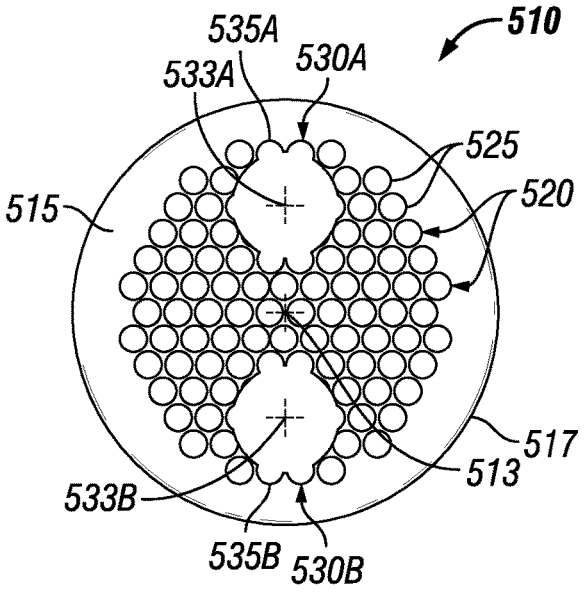
Figure 6:
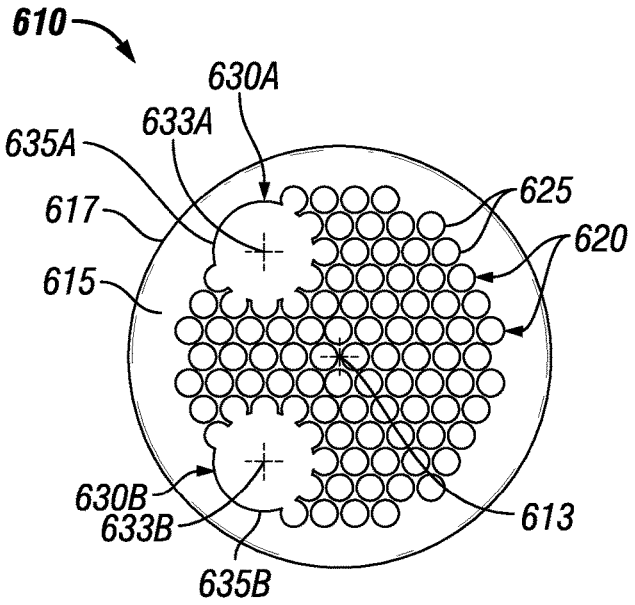

FIGS. 4-6 show various diffuser plates in accordance with certain example embodiments. FIG. 4 shows a top view of diffuser plate 410. FIG. 5 shows a top view of diffuser plate 510. FIG. 6 shows a top view of diffuser plate 610. Referring to FIGS. 1A-6, diffuser plate 310 of FIG. 3 has a body 315 through which a number of apertures traverse.

The diffuser plate 410 of FIG. 4 is substantially the same as the diffuser plate 310 of FIG. 3, except as described below. The smaller apertures 420, when viewed from above, can have any of a number of shapes and/or sizes. Examples of shapes of an aperture 420 can include, but are not limited to, a circle (as in this case), a square, an octagon, a triangle, an oval, and an irregular shape. The shape and/or size of one of the apertures 420 can be the same as, or can be different than, the shape and/or size of one or more of the other apertures 420.

In certain example embodiments, the shape and size of the apertures 420 are substantially the same as the shape and size of the tubes (e.g., tubes 202). In this way, a tube can be disposed within an aperture 420. Alternatively, an end of a tube can abut against the body 415 of the diffuser plate 410 adjacent to an aperture 420, so that the aperture 420 and the cavity within the tube are substantially continuous. The apertures 420 can be positioned on the body 415 of the example diffuser plate 410 in an organized fashion, similar to the diffuser plate 310 of FIG. 3 and as shown in FIG. 4. Alternatively, the apertures 420 can be can be positioned on the body 415 in some other (e.g., random) fashion.

As for the larger aperture (in this case, the larger aperture 430, defined by outer perimeter 435 and having approximate center 433), there can be one or more such larger apertures 430, and at least one of those larger apertures 430 is not centered at the center 413 of the body 415 of the diffuser plate 410. For example, with the example diffuser plate 410 of FIG. 4, there is one aperture 430 that is positioned toward the far left side of the body 415 of the diffuser plate 410, proximate to the outer perimeter 417 of the body 415.

The shape (when viewed from above) of an aperture 430 formed by the outer perimeter 435 can vary. Examples of such a shape can include, but are not limited to, a circle, a square, an octagon, a triangle, an oval, and an irregular shape (as in this case). The shape of aperture 430 can be the same as, or different than, the shape of one or more of apertures 420. The size of an aperture 430 formed by the outer perimeter 435 can also vary. For example, the size of aperture 430 can be smaller or larger than the size of one or more of apertures 420.

Also, the shape of aperture 430 can be the same as or different than the shape of aperture 330 of FIG. 3, regardless of whether aperture 430 is not completely bounded by apertures 420. As a result of the configuration of aperture 430 and apertures 420, the apertures 420, defined by outer perimeters 425, are not positioned symmetrically around aperture 430. Rather, aperture 430 and apertures 420 are positioned symmetrically with respect to a horizontal axis that runs through the center 413 of the body 415 of the diffuser plate 410.

The shape of the body 415 formed by the outer perimeter 417 of the example diffuser plate 410 can vary. Examples of such a shape can include, but are not limited to, a circle (as in this case), a square, an octagon, a triangle, an oval, and an irregular shape. The size of the body 415 formed by the outer perimeter 417 can also vary. For example, the size of the body 415 formed by the outer perimeter 417 can be the same as, or slightly less than, the portion of the cavity (e.g., cavity 155) in which the diffuser plate 410 is disposed.

An example diffuser plate 410 can have a uniform or variable thickness along the body 415. The diffuser plate 410 can have any thickness (e.g., one millimeter, one centimeter, one inch, 15 centimeters) needed for a particular application in any type of vessel (e.g., condensing boiler, heat exchanger, water heater) in which the example diffuser plate 410 can be used. The diffuser plate 410 can be made of and/or coated with a thermally conductive material. In addition, or in the alternative, the diffuser plate 410 can be made of and/or coated with a thermally non-conductive material.

The diffuser plate 510 of FIG. 5 is substantially the same as the diffuser plate 410 of FIG. 4, except as described below. In this case, there are multiple (in this case, two) larger apertures 530, defined by outer perimeter 535. Specifically, aperture 530A is defined by outer perimeter 535A and approximate center 533A, and aperture 530B is defined by outer perimeter 535B and approximate center 533B. The shape of outer perimeter 535A has a number of protrusions that extend from an outer perimeter of the larger aperture 530A, where each protrusion represents an overlap of an aperture 520 with aperture 530A. Similarly, the shape of outer perimeter 535B has a number of protrusions that extend from an outer perimeter of the larger aperture 530B, where each first protrusion represents an overlap of an aperture 520 with aperture 530B. Aperture 535A is positioned toward the far top side of the body 515 of the diffuser plate 510, proximate to the outer perimeter 517 of the body 515, and aperture 535B is positioned toward the far bottom side of the body 515 of the diffuser plate 510. In this way, the apertures 520 are arranged in a pattern, and the pattern is interrupted by aperture 530A and aperture 530B to create an arrangement of the apertures 520.

In this example, aperture 530A and aperture 530B are substantially the same shape and size as each other. Further, the size of aperture 530A and aperture 530B are smaller than the size of aperture 430 or aperture 330, but are larger than the size of apertures 520. In addition, the shape of aperture 530A and aperture 530B appear to be substantially the same as the shape of aperture 330 of FIG. 3. As a result of the configuration of apertures 520, aperture 530A, and aperture 530B, apertures 520, defined by outer perimeters 525, are not positioned symmetrically around aperture 530A and/or aperture 530B. Rather, aperture 530A, aperture 530B, and apertures 520 are positioned symmetrically with respect to a horizontal axis and a vertical axis that runs through the center 513 of the body 515 of the diffuser plate 510.

The diffuser plate 610 of FIG. 6 is substantially the same as the diffuser plates of FIGS. 4 and 5, except as described below. In this case, as with the diffuser plate 510 of FIG. 5, there are multiple (in this case, two) larger apertures 630, defined by outer perimeter 635. Specifically, aperture 630A is defined by outer perimeter 635A and approximate center 633A, and aperture 630B is defined by outer perimeter 635B and approximate center 633B. Aperture 635A is positioned toward the top-left side of the body 615 of the diffuser plate 610, proximate to the outer perimeter 617 of the body 615, and aperture 635B is positioned toward the bottom-left side of the body 615 of the diffuser plate 610.

In this example, aperture 630A and aperture 630B are substantially the same shape and size as each other. Further, the size of aperture 630A and aperture 630B is approximately the same size of aperture 530A and aperture 530B, which are smaller than the size of apertures 520. In addition, the shape of aperture 630A and aperture 630B appear to be substantially the same as the shape of aperture 530A and aperture 530B of FIG. 5. As a result of the configuration of apertures 620, aperture 630A, and aperture 630B, apertures 620, defined by outer perimeters 625, are not positioned symmetrically around aperture 630A and/or aperture 630B. Rather, aperture 630A, aperture 630B, and apertures 620 are positioned symmetrically with respect to a horizontal axis that runs through the center 613 of the body 615 of the diffuser plate 610.

Figure 8:
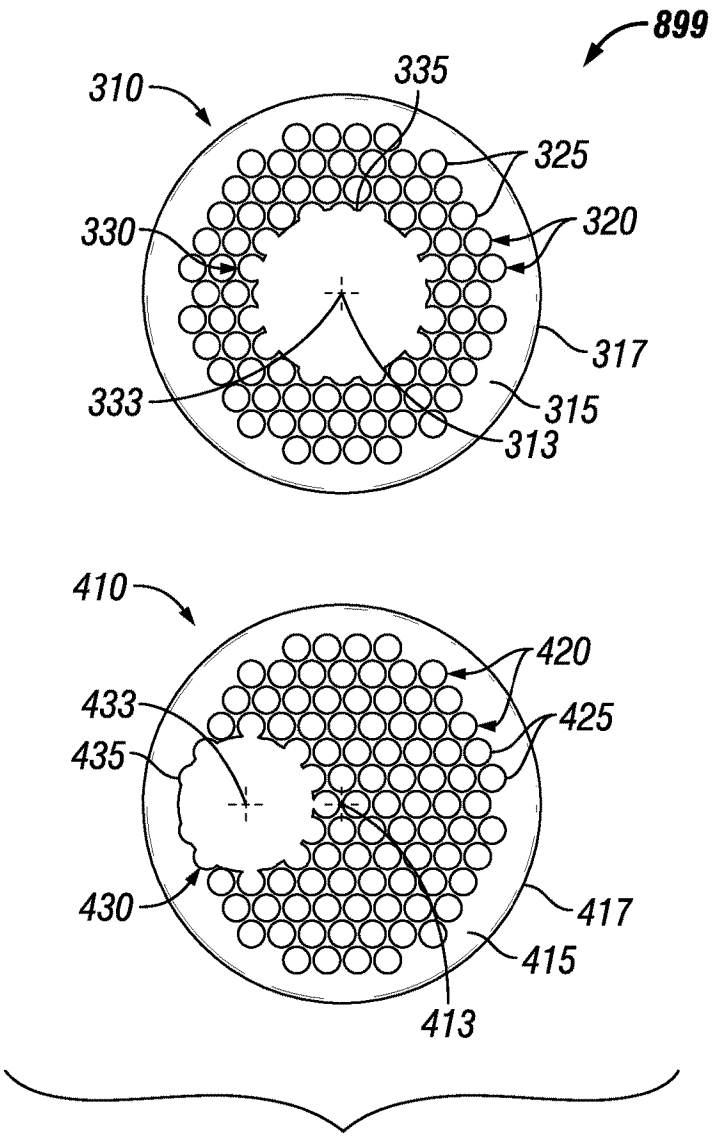
FIGS. 7-10 shows diffuser plate assemblies in accordance with certain example embodiments.
Figure 7:
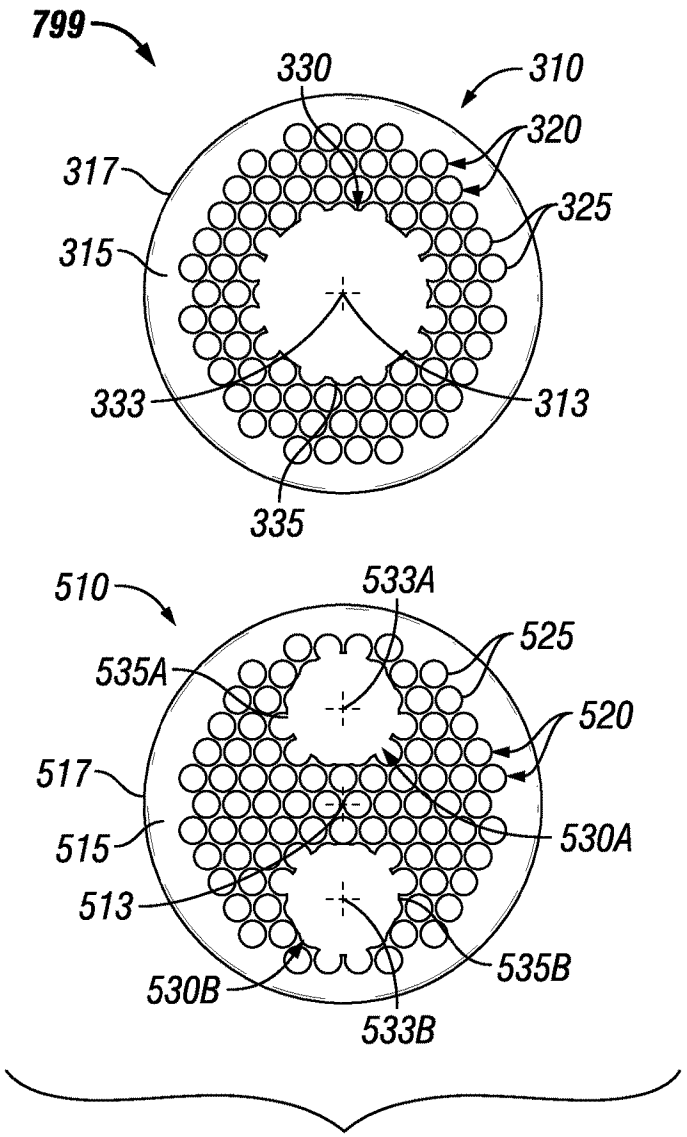
Figure 10:
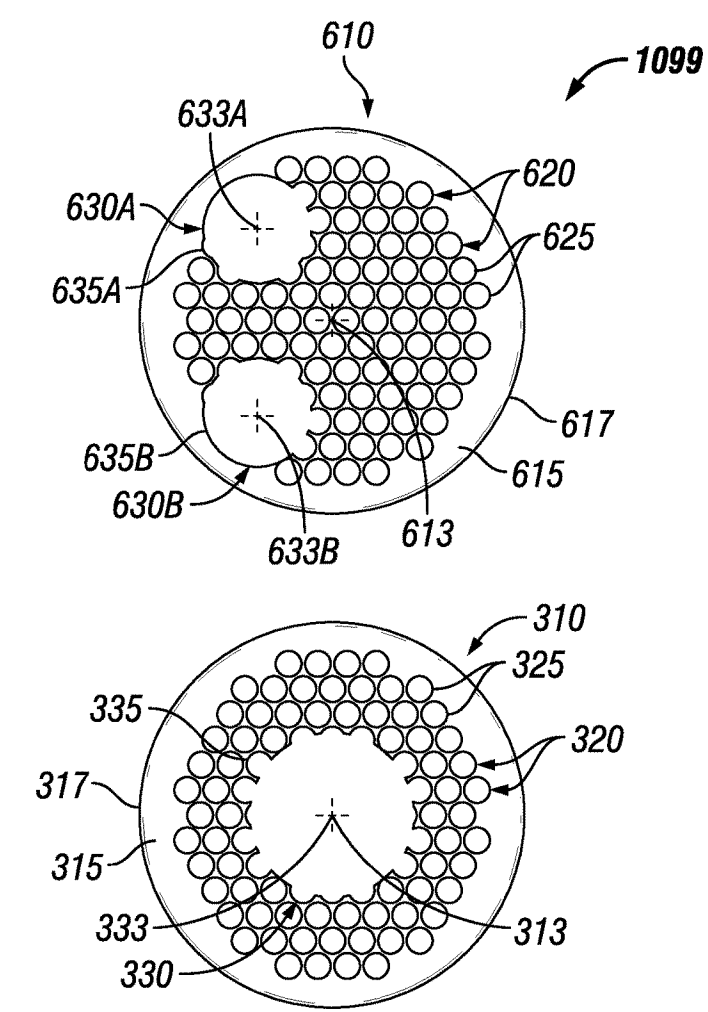
Figure 9:
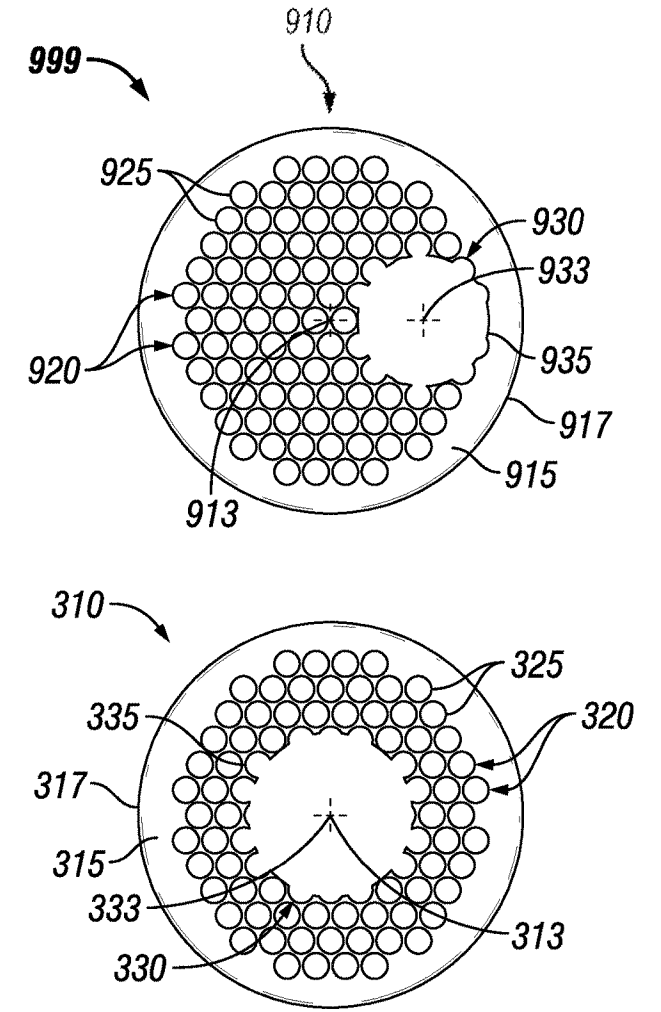

FIGS. 7-10 show various diffuser plate assemblies in accordance with certain example embodiments. Specifically, FIG. 7 shows diffuser plate assembly 799. FIG. 8 shows diffuser plate assembly 899. FIG. 9 shows diffuser plate assembly 999. FIG. 10 shows diffuser plate assembly 1099. In FIGS. 7-10, a top view is shown of each diffuser plate in the diffuser plate assembly. While the example diffuser plate assemblies shown in FIGS. 7-10 have two diffuser plates, a diffuser plate assembly can have more than two (e.g., three, five, ten) diffuser plates. Further, as long as at least one example diffuser plate described herein is used in a diffuser plate assembly, diffuser plates currently known in the art (such as diffuser plate 310 of FIG. 3) can be used in example diffuser plate assemblies.

Also, while FIGS. 7-10 show that the configuration of the apertures of the diffuser plates in a diffuser plate assembly differ from each other, there are other aspects of the diffuser plates in a diffuser plate assembly that can differ from each other. For example, one diffuser in a diffuser plate assembly can have a greater overall diameter (e.g., diameter 316) relative to one or more of the other diffuser plates in the diffuser plate assembly. As another example, one or more characteristics (e.g., number, shape, size, distance between apertures) of the apertures in one diffuser plate can differ from the corresponding characteristic of the apertures in one or more of the other diffuser plates in the diffuser plate assembly.

Referring to FIGS. 1A-10, the diffuser plate assembly 799 of FIG. 7 includes diffuser plate 310 of FIG. 3 and diffuser plate 510 of FIG. 5. Diffuser plate 310 can be positioned at the top or the bottom of the diffuser plate assembly 799. Similarly, diffuser plate 510 can be positioned at the bottom or the top of the diffuser plate assembly 799. In any case, the larger aperture 330 of diffuser plate 310 is not vertically aligned with the larger apertures 530 of diffuser plate 510. Any one of the smaller apertures 320 of diffuser plate 310 can be vertically aligned or not vertically aligned with one or more smaller apertures 520 of diffuser plate 510. In this way, the arrangement of the apertures 320 of diffuser plate 310 differs from the arrangement of apertures 520 of diffuser plate 510.

As discussed above, the shape and/or size of aperture 330 of diffuser plate 310 can be the same as, or different than, the shape and/or size of one or both of apertures 530 of diffuser plate 510. In addition, the shape and/or size of aperture 530A of diffuser plate 510 can be the same as, or different than, the shape and/or size of aperture 530B of diffuser plate 510. Further, the shape and/or size of one of the apertures 320 of diffuser plate 310 can be the same as, or different than, the shape and/or size of one or more of the other apertures 320 of diffuser plate 310. Similarly, the shape and/or size of one of the apertures 320 of diffuser plate 310 can be the same as, or different than, the shape and/or size of apertures 520 of diffuser plate 510. Finally, the shape and/or size of one of the apertures 520 of diffuser plate 510 can be the same as, or different than, the shape and/or size of one or more of the other apertures 520 of diffuser plate 510.

The diffuser plate assembly 899 of FIG. 8 includes diffuser plate 310 of FIG. 3 and diffuser plate 410 of FIG. 4. Diffuser plate 310 can be positioned at the top or the bottom of the diffuser plate assembly 899. Similarly, diffuser plate 410 can be positioned at the bottom or the top of the diffuser plate assembly 899. In any case, the larger aperture 330 of diffuser plate 310 is not vertically aligned with the larger aperture 430 of diffuser plate 410. Any one of the smaller apertures 320 of diffuser plate 310 can be vertically aligned or not vertically aligned with one or more smaller aperture 420 of diffuser plate 410.

As discussed above, the shape and/or size of aperture 330 of diffuser plate 310 can be the same as, or different than, the shape and/or size of aperture 430 of diffuser plate 410. Further, the shape and/or size of one of the apertures 320 of diffuser plate 310 can be the same as, or different than, the shape and/or size of one or more of the other apertures 320 of diffuser plate 310. Similarly, the shape and/or size of one of the apertures 320 of diffuser plate 310 can be the same as, or different than, the shape and/or size of apertures 420 of diffuser plate 410. Finally, the shape and/or size of one of the apertures 420 of diffuser plate 410 can be the same as, or different than, the shape and/or size of one or more of the other apertures 420 of diffuser plate 410.

The diffuser plate assembly 999 of FIG. 9 includes diffuser plate 310 of FIG. 3 and diffuser plate 910. Essentially, the diffuser plate assembly 999 of FIG. 9 is the same as the diffuser plate assembly 499 of FIG. 4 described above, except that the orientation is reversed relative to the vertical axis that runs through the center 913 of the body 915 of the diffuser plate 910. In other words, the larger aperture 930, defined by outer perimeter 935 and having center 933, is disposed toward the right edge of the diffuser plate 910, toward the outer perimeter 917 of the body 915. As a result of the configuration of aperture 930 and apertures 920, the apertures 920, defined by outer perimeters 925, are not positioned symmetrically around aperture 930. Rather, aperture 930 and apertures 920 are positioned symmetrically with respect to a horizontal axis that runs through the center 913 of the body 915 of the diffuser plate 910.

Returning to the diffuser plate assembly 999 of FIG. 9, diffuser plate 310 can be positioned at the top or the bottom of the diffuser plate assembly 999. Similarly, diffuser plate 910 can be positioned at the bottom or the top of the diffuser plate assembly 999. In any case, the larger aperture 330 of diffuser plate 310 is not vertically aligned with the larger aperture 930 of diffuser plate 910. Any one of the smaller apertures 320 of diffuser plate 310 can be vertically aligned or not vertically aligned with one or more smaller aperture 920 of diffuser plate 910.

As discussed above, the shape and/or size of aperture 330 of diffuser plate 310 can be the same as, or different than, the shape and/or size of aperture 930 of diffuser plate 910. Further, the shape and/or size of one of the apertures 320 of diffuser plate 310 can be the same as, or different than, the shape and/or size of one or more of the other apertures 320 of diffuser plate 310. Similarly, the shape and/or size of one of the apertures 320 of diffuser plate 310 can be the same as, or different than, the shape and/or size of apertures 920 of diffuser plate 910. Finally, the shape and/or size of one of the apertures 920 of diffuser plate 910 can be the same as, or different than, the shape and/or size of one or more of the other apertures 920 of diffuser plate 910.

The diffuser plate assembly 1099 of FIG. 10 includes diffuser plate 310 of FIG. 3 and diffuser plate 610 of FIG. 6. Diffuser plate 310 can be positioned at the top or the bottom of the diffuser plate assembly 1099. Similarly, diffuser plate 610 can be positioned at the bottom or the top of the diffuser plate assembly 1099. In any case, the larger aperture 330 of diffuser plate 310 is not vertically aligned with the larger apertures 630 of diffuser plate 610. Any one of the smaller apertures 320 of diffuser plate 310 can be vertically aligned or not vertically aligned with one or more smaller apertures 620 of diffuser plate 610.

As discussed above, the shape and/or size of aperture 330 of diffuser plate 310 can be the same as, or different than, the shape and/or size of one or both of apertures 630 of diffuser plate 610. In addition, the shape and/or size of aperture 630A of diffuser plate 610 can be the same as, or different than, the shape and/or size of aperture 630B of diffuser plate 610. Further, the shape and/or size of one of the apertures 320 of diffuser plate 310 can be the same as, or different than, the shape and/or size of one or more of the other apertures 320 of diffuser plate 310. Similarly, the shape and/or size of one of the apertures 320 of diffuser plate 310 can be the same as, or different than, the shape and/or size of apertures 620 of diffuser plate 610. Finally, the shape and/or size of one of the apertures 620 of diffuser plate 610 can be the same as, or different than, the shape and/or size of one or more of the other apertures 620 of diffuser plate 610.

Example embodiments described herein allow for flexible and more efficient designs for condensing boilers, heat exchangers, water heaters, and other vessels in which example diffuser plates can be used. Example embodiments can be used to improve the flow of fluid through condensing boilers, heat exchangers, water heaters, or other vessels, where such fluids absorb thermal energy (e.g., heat, cold) for use in another process. Example embodiments can also be used to help ensure that these fluids are physically separated from the fuel used to drive the transfer of the thermal energy. Example embodiments can be customizable with respect to any of a number of characteristics (e.g., shape, size, aperture configuration). Further, the shape, size, and dimensions of an example diffuser plate can be specifically configured for a particular condensing boiler, heat exchanger, water heater, or other vessel. Example embodiments can be mass produced or made as a custom order.

Example diffuser plate assemblies can include two or more diffuser plates that are configured differently (e.g., location, size, and/or number of smaller apertures, location, size, and/or number of larger apertures) relative to each other. Such configurations can increase thermal efficiency relative to the current art. For example, tests conducted using example embodiments attained up to a 4% improvement in thermal efficiency. Further, such configurations of diffuser plates in example diffuser plate assemblies can significantly lower the metal or tube temperature (e.g., by 390° F.) at the bottom portion (e.g., in the collection chamber) of the boiler or other vessel. Further, the number of diffuser plates and the location of the diffuser plates in diffuser plate assemblies relative to each other are novel features in the art that promote increased thermal efficiency (e.g., 2.4% improvement), increased mechanical stability, improved fluid and hot gas flow, and increased durability over the current art.

The various configurations, including aperture size, number of apertures, symmetric/asymmetric plate designs, and single/multiple relatively larger aperture variations, of example diffuser plates described herein can help make the flow pattern of the fluid and/or the hot gas in the boiler or other vessel more uniform. Such configurations of the example diffuser plates also reduce the temperature (e.g., by 330° F.) of the tubes, boiler walls, diffuser plates, and other materials with the boiler, heat exchanger, or other vessel, thereby increasing the durability of the boiler, heat exchanger, or other vessel. Example embodiments can also be used in environments that require compliance with one or more standards and/or regulations.

Accordingly, many modifications and other embodiments set forth herein will come to mind to one skilled in the art to which example diffuser plates and diffuser plate assemblies pertain having the benefit of the teachings presented in the foregoing descriptions and the associated drawings. Therefore, it is to be understood that example diffuser plates and diffuser plate assemblies are not to be limited to the specific embodiments disclosed and that modifications and other embodiments are intended to be included within the scope of this application. Although specific terms are employed herein, they are used in a generic and descriptive sense only and not for purposes of limitation.

What is claimed is:

1. A diffuser plate for a thermal transfer device, wherein the diffuser plate comprises:

a body having a plurality of first apertures and a second aperture that traverse therethrough, wherein the plurality of first apertures are asymmetrically arranged with respect to the second aperture, wherein the plurality of first apertures have a first shape and a first size, and wherein the plurality of first apertures are configured to receive a plurality of tubes, wherein the second aperture has an outer perimeter and a second size, wherein the second size is larger than the first size, and wherein the outer perimeter of the second aperture comprises a plurality of first protrusions, wherein each first protrusion of the plurality of first protrusions represents a first overlap of a first aperture with the second aperture.

2. The diffuser plate of claim 1, wherein the first shape is circular.

3. The diffuser plate of claim 1, wherein the second aperture is substantially circular.

4. The diffuser plate of claim 1, wherein the second aperture is substantially square.

5. The diffuser plate of claim 1, further comprising: a third aperture having the second size.

6. The diffuser plate of claim 1, further comprising: a third aperture having a third size.

7. The diffuser plate of claim 1, wherein the plurality of first apertures, without considering the second aperture, are symmetrically arranged along a horizontal axis that traverses a center of the body.

8. The diffuser plate of claim 1, wherein the plurality of first apertures, without considering the second aperture, are symmetrically arranged along a vertical axis that traverses a center of the body.

9. A diffuser plate for a thermal transfer device, wherein the diffuser plate comprises:

a body having a plurality of first apertures, a second aperture, and a third aperture that traverse therethrough, wherein the plurality of first apertures are asymmetrically arranged with respect to the second aperture, wherein the plurality of first apertures have a first shape and a first size, and wherein the plurality of first apertures are configured to receive a plurality of tubes, wherein the second aperture has a first outer perimeter and a second size, wherein the second size is larger than the first size, wherein the first outer perimeter of the second aperture comprises a plurality of first protrusions, wherein each first protrusion of the plurality of first protrusions represents a first overlap of a first aperture with the second aperture, wherein the third aperture has a second outer perimeter, and wherein the second outer perimeter of the third aperture comprises a plurality of second protrusions, wherein each second protrusion of the plurality of second protrusions represents a second overlap of a first aperture with the third aperture.

10. The diffuser plate of claim 9, wherein the first shape is circular.

11. The diffuser plate of claim 9, wherein the second aperture and the third aperture are substantially circular.

12. The diffuser plate of claim 9, wherein the second aperture is substantially square, and wherein the third aperture is substantially circular.

13. The diffuser plate of claim 9, wherein the second aperture and the third aperture have a second shape that substantially differs from the first shape.

14. The diffuser plate of claim 9, wherein the third aperture has the second size.

15. The diffuser plate of claim 9, wherein the third aperture has a third size, wherein the third size is larger than the first size.

16. The diffuser plate of claim 9, wherein the plurality of first apertures are further asymmetrically arranged with respect to the third aperture.

17. A thermal transfer device comprising:

an enclosure comprising at least one wall that forms a cavity;

a plurality of tubes disposed within the cavity; and a first diffuser plate disposed within the cavity, wherein the first diffuser plate comprises a first body having a plurality of first apertures and a second aperture, wherein the plurality of first apertures and the second aperture traverse through the first diffuser plate, wherein the plurality of tubes are disposed within the plurality of first apertures and the plurality of first apertures have a first shape and a first size, wherein the second aperture has a first outer perimeter and a second size, wherein the second size is larger than the first size, and wherein the first outer perimeter of the second aperture comprises a plurality of first protrusions, wherein each first protrusion of the plurality of first protrusions represents a first overlap of a first aperture with the second aperture.

18. The thermal transfer device of claim 17, further comprising:

a second diffuser plate disposed within the cavity in parallel with the first diffuser plate, wherein the second diffuser plate comprises a second body having a plurality of third apertures, wherein the plurality of third apertures traverse through the second diffuser plate, and wherein the plurality of tubes are further disposed within the plurality of third apertures.

19. The thermal transfer device of claim 18, wherein the second diffuser plate further comprises a fourth aperture that traverses the second diffuser plate, wherein the fourth aperture has a second outer perimeter, wherein the second outer perimeter of the fourth aperture comprises a plurality of second protrusions, wherein each second protrusion of the plurality of second protrusions represents a second overlap of a third aperture with the fourth aperture.

20. The thermal transfer device of claim 19, wherein the plurality of first apertures and the second aperture of the first diffuser plate is configured differently from the plurality of third apertures and the fourth aperture of the second diffuser plate.

* * * * *